United States Patent [19]

Bullock et al.

[11] Patent Number: 4,621,756

[45] Date of Patent: Nov. 11, 1986

[54] WEB FEEDING MECHANISM

[75] Inventors: Michael K. Bullock, Matthews; Dennis R. Hedrick, High Point; Richard H. Marvin, Concord; Edmund H. James, III, Matthews, all of N.C.

[73] Assignee: International Business Machines Corporation, Armonk, N.Y.

[21] Appl. No.: 627,303

[22] Filed: Jul. 2, 1984

[51] Int. Cl.[4] ..... B65H 20/02; B65H 20/20; B65H 20/40; B65H 23/14

[52] U.S. Cl. ..... 226/76; 226/186; 226/188; 226/192; 226/195

[58] Field of Search ..... 226/192, 191, 188, 186, 226/195, 74, 76, 143; 242/75.2; 400/608.1, 618

[56] References Cited

U.S. PATENT DOCUMENTS

| | | | |
|---|---|---|---|
| 3,180,548 | 4/1965 | Stafford | 226/195 |
| 3,285,484 | 11/1966 | Johnson | 226/195 X |
| 3,326,156 | 6/1967 | Cobble, Sr. et al. | 226/195 X |
| 3,420,158 | 1/1969 | Kobiella | 226/143 X |
| 3,586,149 | 6/1971 | Miller | 400/618 |
| 3,659,797 | 5/1972 | Coy | 226/191 X |
| 3,800,992 | 4/1974 | Yamagishi | 226/74 X |
| 3,980,207 | 9/1976 | Maccaferri | 226/191 X |
| 4,221,480 | 9/1980 | Spehrley, Jr. | 226/192 X |
| 4,389,009 | 6/1983 | Yamashita | 226/188 |
| 4,428,284 | 1/1984 | Thorne | 101/93.04 |

FOREIGN PATENT DOCUMENTS

| | | |
|---|---|---|
| 0061635 | 3/1982 | European Pat. Off. . |
| 59-2873 | 4/1984 | Japan . |

OTHER PUBLICATIONS

IBM Technical Disclosure Bulletin, vol. 22, No. 7, pp. 2616–2617, Dec. 1979.

*Primary Examiner*—Harvey C. Hornsby
*Assistant Examiner*—Scott J. Haugland
*Attorney, Agent, or Firm*—Bell, Seltzer, Park & Gibson

[57] ABSTRACT

A printer includes a print mechanism for performing printing operations and a print medium feeding mechanism for feeding a print medium past the print mechanism so that printing operations can be performed on the print medium. The print medium feeding mechanism includes a forward feed apparatus located downstream of the print mechanism for feeding the print medium in the forward direction past the print mechanism and a print medium tensioning apparatus. The tensioning apparatus includes at least one pair of pressure wheels rotatably mounted on the frame and located on opposite sides of a print medium being fed by the forward feed apparatus and means for restricting the rotation of at least one of the pressure wheels, whereby the pressure wheels exert a retarding force on the print medium tending to tension the print medium. Each pressure wheel is constructed so that it is flexible in the axial direction so as to permit lateral movement of a print medium as it passes between the pair of pressure wheels.

The print medium feeding mechanism also includes drive means for rotating at least one of the pressure wheels in the reverse direction so as to provide for reverse feed of the print medium. This drive means is coupled through a one way coupling so as not to affect the ability of the pressure wheel to rotate during forward feed of the print medium.

5 Claims, 10 Drawing Figures

WEB FEEDING MECHANISM

FIELD OF THE INVENTION

The present invention relates to apparatus of the type which includes an operating mechanism for performing operations on a web of material and in particular to the part of the apparatus which is used for feeding the web through the operating mechanism and for ensuring that the web is correctly aligned while it is being fed through the operating mechanism. The invention has a particular application in printers.

BACKGROUND OF THE INVENTION

Printers of known kind are provided with print mechanisms including print regions in which the printing operation is performed. Each such printer is supplied with a print medium on which the printing takes place. The print medium is commonly paper and for convenience the paper is formed into a continuous web. The web is fed through the print region of the printer by a suitable feeding mechanism. As the web is fed through the printer the print mechanism performs printing operations on the web. In order to ensure that the printing operations result in characters being printed in the correct positions on the paper it is essential that the paper be aligned correctly with the print mechanism throughout the printing operation.

The paper web is commonly fed through the printer by means of tractor mechanisms. These mechanisms include wheels formed with pins on their peripheries or pairs of wheels driving a belt formed with pins. The pins engage in holes formed in the web near the side edges of the web. Each tractor mechanism is driven by a suitable drive means and as the tractor wheels rotate or the belt moves the pins engage in successive holes in the web and feed the web through the printer.

The printer includes a platen in its print region where printing takes place. The paper web is fed over the platen. In known arrangements two tractors are located on the downstream side of the platen (in relation to the movement of the web) to draw the web through the print region over the platen during forward feed. It is necessary to ensure that the web is tensioned as it passes over the platen in order to ensure that printing takes place on a flat area of the web. In order to tension the web it is known to provide tensioners formed with spring biased arms which engage the surface of the web thereby retarding the movement of the web through the printer. These tensioners are located on the upstream side of the platen retarding the movement of the paper web as it is fed through the printer by the tractor mechanism. The tensioners thereby tension the web and ensure that the paper web is flat as it passes over the platen.

It is difficult to ensure that the tension exerted by the tensioners of this type is correct since it relies upon the friction between the spring biased arm and the surface of the web. This friction may vary from time to time with changes in the ambient conditions and will vary with different kinds of paper. Also with this type of tensioner it is not possible to provide for feed of the paper web in the reverse direction since the arm tends to damage the web.

In order to provide for reverse feed of the paper web it is known to replace the tensioners which have the spring biased arms by additional tractors located upstream of the platen. For forward feed of the paper web the tractors located downstream of the platen are driven and the tractors located upstream of the platen are not driven but are arranged to provide a drag which tensions the paper web. For reverse feed of the paper web the upstream tractors are driven and the downstream tractors are not driven. The downstream tractors may be arranged to provide a drag which tensions the paper web during reverse feed.

All the tractors include wheels or belts formed with pins which engage in holes in the web. These do not allow lateral movement of the web in the region of the tractors. If the web stretches or there is some misalignment between the upstream and downstream tractors the pins on the downstream tractors will try to position the web in one way and the pins on the upstream tractors will try to position the web in another way. As a result the web will be stressed and distorted and will not be correctly aligned in the print region.

While the background of the invention has been illustrated with reference to a printer it will be appreciated that the same problems will occur in the feeding of a web through other operating mechanisms, for example feeding a paper web through a punch mechanism or feeding a web through a mechanism for detecting marks on the web.

The object of the present invention is to provide apparatus for performing operations on a web having an operating mechanism and an improved web feeding mechanism for feeding a web past the operating mechanism which tensions the web as it passes the operating mechanism and allows for lateral alignment of the web with the operating mechanism under the control of only one part of the feeding mechanism.

A further object of the present invention is to provide apparatus of the above type having an improved web feeding mechanism for feeding the web in the reverse direction past the operating mechanism which maintains the web under tension.

A still further object of the present invention is to provide apparatus having an improved web feeding mechanism for tensioning the web during both forward and reverse feed of the web past the operating mechanism which does not damage the surface of the web.

SUMMARY OF THE INVENTION

A web feeding mechanism for apparatus for performing operations on a web includes a forward feed apparatus for feeding the web in the forward direction past an operating mechanism and located downstream of the operating mechanism and a web tensioning apparatus located upstream of the operating mechanism for tensioning the web as it is fed past the operating mechanism. The tensioning apparatus includes at least one pair of pressure wheels which are rotatably mounted and abut against opposite surfaces of a web which is being fed by the forward feed apparatus. The rotation of a least one of the pressure wheels is restricted so as to exert a retarding force on the web as it passes between the pressure wheels and rotates the pressure wheels. This results in the web medium being tensioned. Each of the pressure wheels is flexible in the axial direction so as to permit lateral movement in the axial direction relative to the pressure wheels of the web as it passes between the pressure wheels. This allows the web to be aligned relative to the operating mechanism under the control of the forward feed apparatus only.

Each pressure wheel is formed from a flexible disc having radially extending slots which divide the disc into segments. Each segment can move axially relative to the adjacent segments. The segment which is in contact with the web at any instant can move axially and this provides for lateral movement of the web.

The web feeding mechanism also includes means for rotating at least one of the pressure wheels in the reverse direction to provide for reverse feeding of the web. As this pressure wheel is rotated in the reverse direction to provide a first speed of movement of the web in the reverse direction, the forward feed apparatus is driven in the reverse direction to provide a second speed of movement of the web in the reverse direction which is less than the first speed of movement. Slippage is allowed to occur between each pressure wheel and the web so that the web is fed in the reverse direction at the second speed and each pressure wheel exerts a force on the web tending to move it faster than the second speed. As result the web is tensioned during reverse feed.

The drive to the pressure wheel providing for rotation of the pressure wheel in the reverse direction includes a one way coupling so as to allow rotation of this pressure wheel for forward feed independently of this drive.

Each pressure wheel is constructed so that, if a radial force is applied to the rim of the wheel, the wheel will deform radially without any axial deformation. This reduces the possibility of the pressure wheel distorting the web or damaging the surface of the web.

BRIEF DESCRIPTION OF THE DRAWINGS

These and other objects, features and advantages of the invention will be more fully understood by those working in the art by reading and understanding the following description of a preferred embodiment of the invention, wherein reference is made to the accompanying drawings of which.

DETAILED DESCRIPTION OF THE INVENTION

Figure 1:
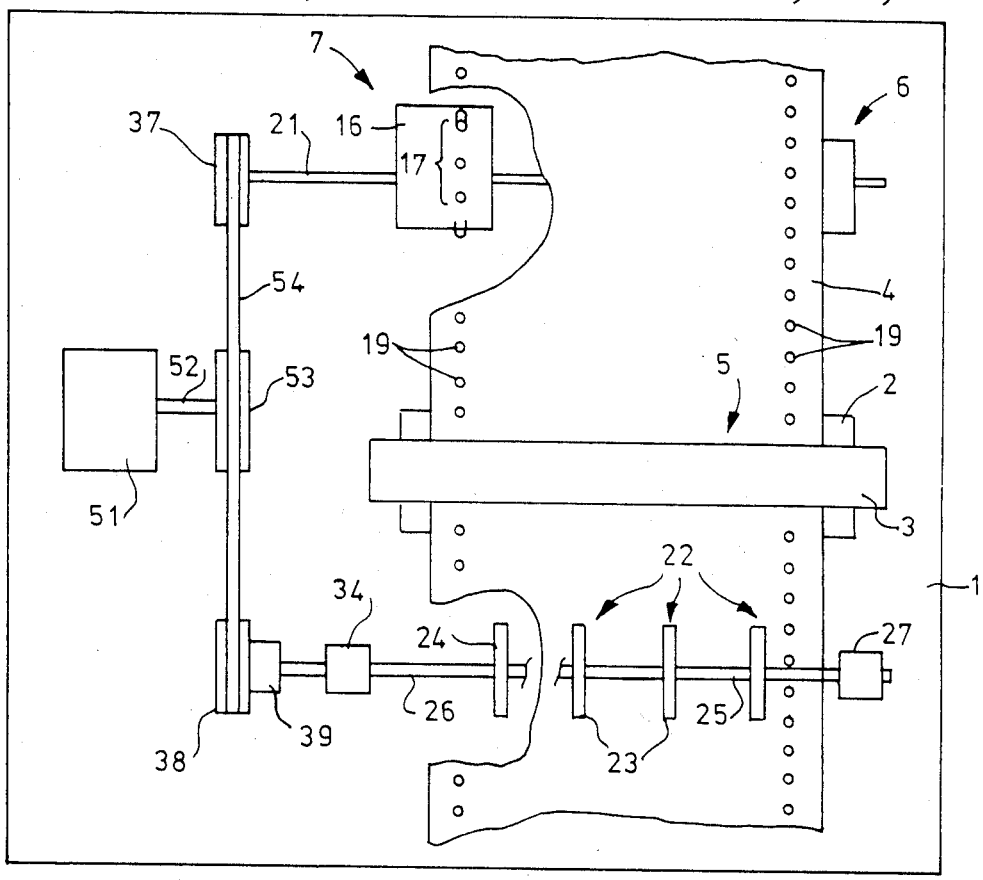
FIG. 1 is a diagrammatic front view of a printer including a print medium feeding mechanism in accordance with the present invention.
Figure 2:
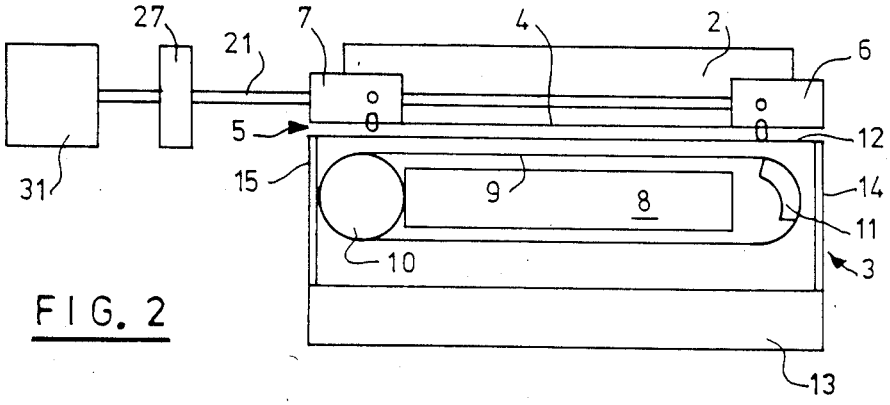
FIG. 2 is a plan view of the printer of FIG. 1.

With reference to FIGS. 1 and 2 a printer incorporating a print medium feeding mechanism arrangement in accordance with the invention includes a frame indicated diagrammatically at 1 on which are mounted a platen 2 and a print mechanism 3. A print medium 4, which is a continuous paper web, extends through the space 5 between the platen 2 and the print mechanism 3 which is known as the print region so that printing operations can be performed on the medium using the print mechanism. The web 4 is fed through the print region 5 by means of two tractors 6,7 which will be described in more detail below.

As seen more clearly in FIG. 2 the print mechanism 3 includes a bank of hammers 8 extending along the print region 5 parallel to the platen 2 and a flexible metal band 9 in the form of a continuous loop and on which are mounted print elements. The band 5 passes around a drive wheel 10 and a guide member 11 and is driven through the print region by the drive wheel 10. Between the band 9 and the web 4 extends an ink ribbon 12 which is supplied from a cartridge 13 formed with two arms 14,15 which support the ribbon in the print region 5. The metal band 9 moves continuously through the print region and operation of the hammers in the hammer mechanism 8 causes selected print elements on the band 9 to be pressed against the ribbon 12. The ribbon 12 is thereby pressed against the print medium 4 causing print operations to take place. This method of operation is described in U.S. Pat. No 4,428,284 and will not be described in greater detail here.

Figure 3:
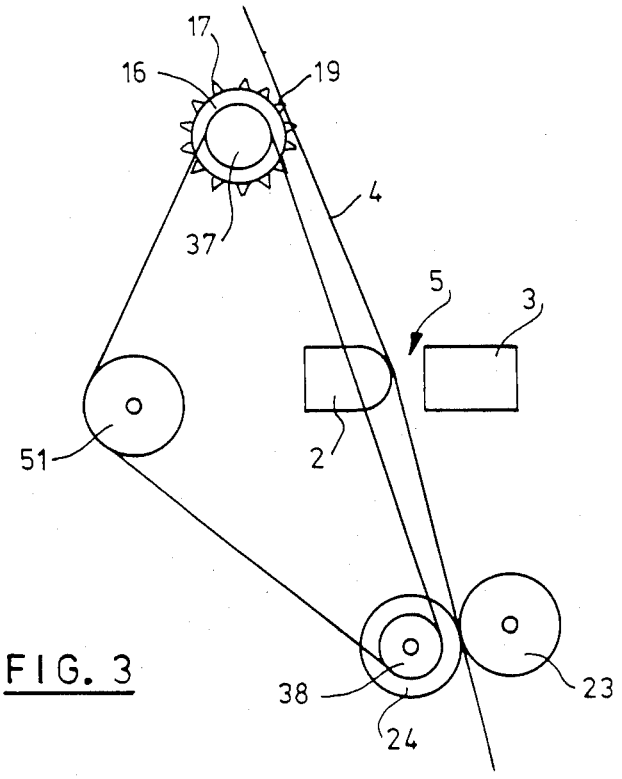
FIG. 3 is a side view of the printer of FIG. 1.

Referring to FIGS. 1 and 3, each of the tractors 6,7 includes a wheel 16 on the periphery of which are formed pins 17 and which is mounted on a shaft 21. As an alternative each of the tractors could consist of a pair of wheels driving a belt formed with pins 17. The pins 17 engage in holes 19 formed near the outer edges of the paper web 4. In order to provide forward feed of the web 4 the shaft 21 is rotated by a drive mechanism to be described in greater detail below and, as the wheels 16 are rotated and the pins 17 engage in successive holes 19, the web 4 is fed upwardly through through the print region 5 as viewed in FIGS. 1 and 3 and as indicated by the arrow.

Figure 4:
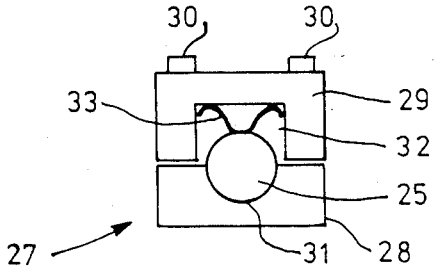
FIG. 4 is a detailed side view of a bearing used in the printer of FIG. 1, FIGS. 5, 6 and 7 are detailed views of a one way clutch device used in the printer of FIG. 1.

Below the print mechanism 3 are mounted four pairs of pressure wheels 22. Each pair of pressure wheels 22 comprises a front pressure wheel 23 and a rear pressure wheel 24. The front pressure wheels 23 are all mounted on an idler shaft 25 and the rear pressure wheels 24 are all mounted on a drive shaft 26. The idler shaft 25 is supported in a plurality of bearings 27 attached to the frame 1. One of these bearings is illustrated in FIG. 4 and it will be seen from this Figure that each bearing comprises a housing in two halves 28, 29 joined together by two bolts 30. One half 28 is formed with a bearing surface 31 which supports the shaft 25. The other half 29 is formed with a recess 32 in which is located a spring member 33. The spring member 33 is pressed against the surface of the shaft 25 and forces the shaft 25 against the bearing surface 31. The spring member 33 also exerts a braking force on the shaft due to the friction between the spring member 33 and the surface of the shaft 25. The drive shaft 26 is also supported in a plurality of suitable bearings 34 of conventional type attached to the frame 1.

The pressure wheel pairs 22 are located so that the front pressure wheels 23 engage with the front surface of the paper web 4 and the rear pressure wheels 24 engage with the rear surface of the web. The bearings 27, 34 for the shafts 25,26 are located in such positions that the pressure wheels 23,24 of each pair 22 are pressed together so that they can clamp the paper web 4 between them. As a result, if the paper web 4 is fed through the printer by the tractors 6, 7 the pressure wheels 23, 24 will rotate causing rotation of the shafts 25, 26. Further, if the drive shaft 26 is rotated, the rear pressure wheels 24 will rotate and since the front pressure wheels 23 press the paper web 4 against the rear pressure wheels the paper web will be moved.

Figure 5:
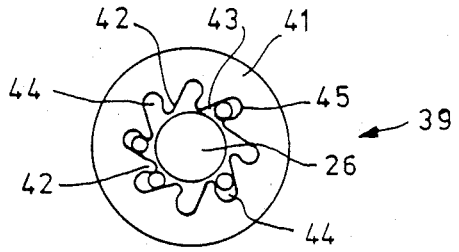
Figure 6:
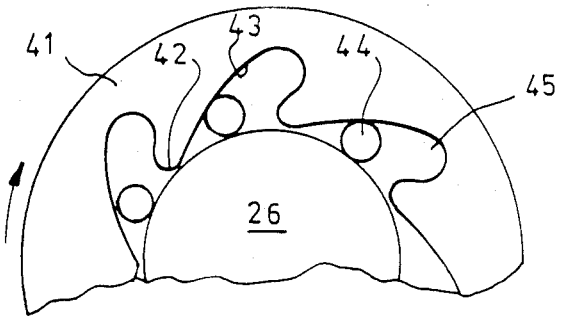
Figure 7:
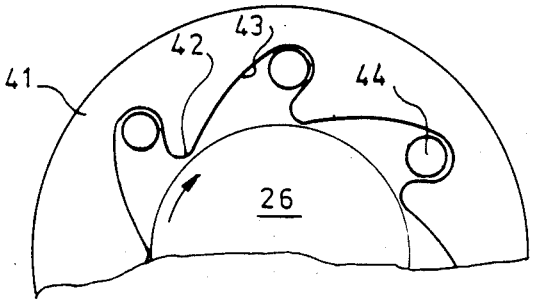

A pulley 37 is connected to the end of the shaft 21 on which are mounted the tractor wheels 16. Another pulley 38 is attached to a one way clutch device 39 mounted on the end of the shaft 26 on which are also mounted the rear pressure wheels 24. The one way clutch device 39 is illustrated in FIGS. 5, 6 and 7. It includes an outer ring member 41 attached to pulley 38 and formed on its inner surface with a series of projections 42 each having an inclined surface 43. Located in the recesses 45 formed between these projections are a set of rollers 44.

The assembly of the outer ring member 41 which is attached to the pulley 38 and the rollers 44 fits around the shaft 26. When the pulley 38 rotates the outer ring member 41 in the clockwise direction as viewed in FIG. 5 each of the rollers 44 will tend to move inwardly up the inclined surface 43 of the recess 45 in which it lies and into contact with the surface of the shaft 26 as illustrated in FIG. 6. This will cause a positive coupling to be formed between the outer ring member 41 and the shaft 26 and will result in the shaft 26 rotating with the outer ring member 41 and the pulley 38. On the other hand when the pulley 38 rotates the outer ring member 41 in the anti-clockwise direction as viewed in FIG. 5 each of the rollers 44 will tend to move outwardly down the inclined surface 43 of the recess 42 in which it lies so that it moves out of contact with the surface of the shaft 26. As a result there will be no positive coupling between the outer ring member 41 and the shaft 26 and the outer ring member 41 will not drive the shaft 26.

Further, if the shaft 26 rotates clockwise as viewed in FIG. 5 with the outer ring member 41 remaining stationary, each of the rollers 44 will tend to move outwardly down the inclined surface 43 of the recess 42 in which it lies so that it moves out of contact with the surface of the shaft 26 as illustrated in FIG. 7. As a result there will be no positive coupling between the shaft 46 and the outer ring member 41 and the shaft 26 will continue to rotate.

The pressure wheel pairs 22 are arranged to provide a dragging force on the web 4 as it is fed by the tractors 6,7 up through the print region 5 as follows.

A drive motor 51 mounted on the frame 1 of the printer is provided with a drive shaft 52 on which is mounted a further pulley 53. A drive belt 54 extends around the pulleys 37, 38 and 53 and rotation of the motor 51 causes rotation of the shafts 52 and 21 and corresponding rotation of the tractor wheels 16, together with rotation of outer ring member 41.

When the motor 51 rotates the shaft 52 in such a direction that shaft 21 rotates the tractor wheels 16 so as to provide forward feed of the paper web 4 through the print region 5, upwardly in FIG. 1, the outer ring member 41 will be rotated in the anti-clockwise direction as viewed in FIG. 5. As explained above, in this condition, there is no coupling between the outer ring member 41 and the shaft 26 and rotation of the outer ring member 41 will not cause the shaft 26 to rotate.

During the normal forward feed of the web under the action of the tractor wheels 16 movement of the web will cause rotation of the pressure wheels 23, 24 and rotation of the shaft 26 as described above. This rotation of shaft 26 will be anti-clockwise as viewed in FIG. 5. By suitable selection of the diameters of the pulleys 37, 38, the tractor wheels 16 and the pressure wheels 24, the anti-clockwise rotational speed of shaft 26 will be less than the anti-clockwise rotational speed of the outer ring member 41. As a result, effectively, the shaft 26 will be rotating clockwise relative to the outer ring member 41 and in this condition, as described above with reference to FIG. 7, there will be no positive coupling through the one way clutch device 39 between the shaft 26 and the outer ring member 41 so that the shaft 26 will rotate freely. However shaft 25 will not rotate freely because the spring members 33 in the bearings 27 will exert a braking force on the shaft 25 as described above. This braking force will be imparted to the pressure wheels 23.

Therefore, as the web 4 is fed up through the print region by the tractors 6,7, the pressure wheels 23 will be rotated by the web as it moves and, since there is a braking force exerted on the pressure wheels 23, a dragging force will be exerted on the web resulting in the web being tensioned. This will ensure that the web is flat as it passes through the print region 5. This flatness is necessary to ensure that printing by the print mechanism 3 takes place correctly.

The tractor wheels 16, through the action of the pins 17 engaging in the holes 19, control the positions of the edges of the web 4 positively. They define the positions of the edges of the web relative to the print mechanism 3. The tractors 6,7 can be moved laterally relative to the direction of movement of the web so as to position the web as required relative to the print mechanism 3.

Figure 8:
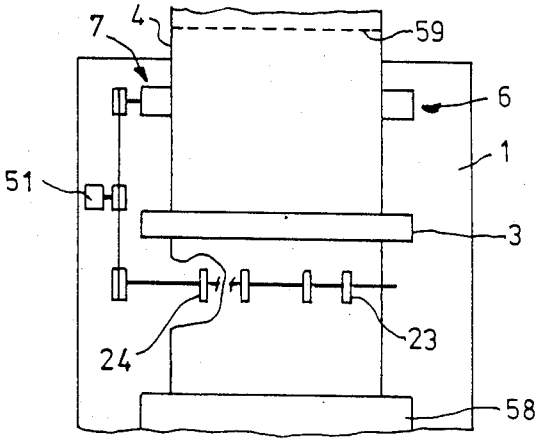
FIG. 8 is a front view of the printer of FIG. 1.

The paper web 4 is supplied from a box 58 located below the printer as illustrated in FIG. 8 which is a diagrammatic front view of the printer illustrated in FIGS. 1, 2 and 3. During the operation of the printer the paper web 4 is drawn up from the box 58 into the bottom of the printer, up through the print mechanism 3 and out of the top of the printer by the action of the tractors 6,7. The upper end of the web is under the control of the tractors 6, 7 and its lateral position within the printer and relative to the print mechanism 3 will be dependent on the positions of the tractors 6, 7. The portion of the web 4 which is emerging from the box 58 at any instant may not be aligned accurately with the print mechanism 3 and the upper end of the web which is passing through the tractors at that instant. In order for the web to become aligned accurately under the control of the tractors 6,7 and to avoid the introduction of stresses and distortion into the web, it may be necessary for the portion of the web which is emerging from the box, before it passes through the print mechanism 3, to be able to move laterally. The pressure wheels 23,24 are constructed in a special way in order to allow for this lateral movement.

Figure 9:
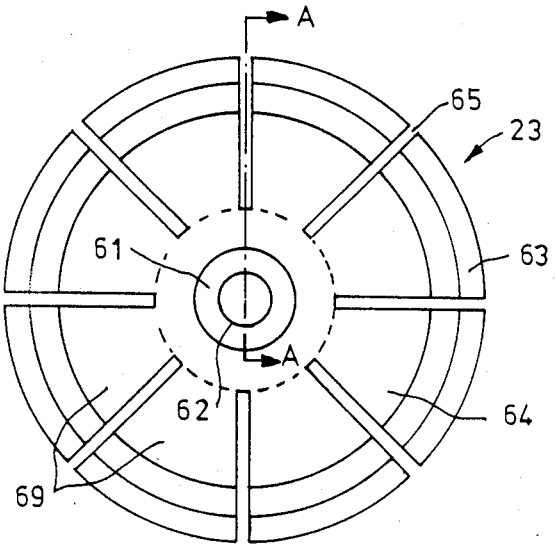
FIG. 9 is a detailed view of one of the pressure wheels used in the printer of FIG. 1.
Figure 10:
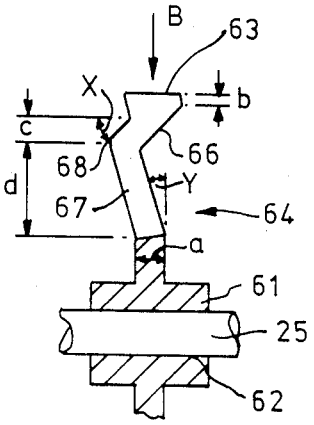
FIG. 10 is a side view of the pressure wheel of FIG. 9 sectioned on the line A—A.

The construction of the pressure wheels 23,24 is illustrated clearly in FIGS. 9 and 10. FIG. 9 is a view of one the wheels 23. Each wheel 24 is constructed in the same way as each wheel 23. The wheel 23 is formed with a hub 61, having a central hole 62, through which extends shaft 25, and an outer rim 63. Between the hub 61 and the outer rim 63 extends a disc portion 64 which is formed with a plurality of radial slots 65. As seen more clearly in FIG. 10, which is a side view of the wheel 23 as illustrated in FIG. 9 sectioned on the line A—A, the disc portion 64 is not flat but is formed form two annular members 66, 67 which meet at an annular joint 68. Each of the annular members 66, 67 is dished and, as seen in FIG. 10, the annular members are positioned so that, in cross section, the two annular members extend at an angle relative to each other and to the axis of the wheel 23. The outer edge of annular member 66 abuts against the rim 63 and the inner edge of annular member 67 abuts against the hub 61. It will also be seen that the rim 63 extends accurately axially of the wheel. The radial slots 65 extend through the rim 63 and through most of the length of the relatively inclined annular members 66,67 so as to define a plurality of radial segments 69. Each slot 65 has a finite width and therefore there is a small space between adjacent segments 65.

The wheel 23 is made of a flexible polymer material so that the segments 69 can move relative to each other in an axial direction. A small amount of relative movement in the circumferential direction is permitted between adjacent segments 69 in view of the spaces between adjacent segments formed by the slots 65. If a radial force is applied to part of the rim 63 as indicated by the arrow B in FIG. 10, this radial force will be transmitted to the annular members 66,67. Since the radially inner end of the annular portion 67 is fixed to the hub 61, the annular members 66,67 will flex and effectively pivot about the elbow joint 68 coupling the two annular members and about the junction points with the hub 61 and the rim 63 so that the two annular members 66,67 will move relative to each other and allow the rim 63 to move radially inwardly with resultant deformation of the wheel. The annular members 66, 67 are so dimensioned that when they move relative to each other under the action of a radial force, pivoting as described, the rim 63 will move accurately radially without any component of movement in the axial direction. Therefore it will be appreciated that the construction of the pressure wheel 23 allows movement of each part of the rim 63 in a radial direction only under the action of a radial force.

On the other hand if an axial force is applied to a portion of the rim 63 the segment 69 to which this portion of the rim is attached will move axially.

Lateral movement of the web in the region of the pressure wheel pairs 22 by the axial deformation of the segments 69 of the wheels is provided for as follows. The web 4 is clamped between each pair of pressure wheels 22 as a result of the relative positions of the shafts 25 and 26 and a dragging force is exerted on the web in the region of each pressure wheel pair by the friction which exists between the shaft 25 and its bearings 27 in order to tension the web as described above. The segment 69 of each pressure wheel which is in contact with the web can move axially to allow for lateral movement of the web for alignment. This axial movement of this segment will affect the dragging force exerted on the web by this segment, but the next segment coming into contact with the web will be in its normal axial position and the dragging force applied to the web by this segment will be normal. The wheel pairs 22 therefore allow for lateral movement of the web to provide for alignment under the control of the tractors 6,7 without appreciably affecting the dragging force applied by the wheel pairs to the web. The tension in the web provided by this dragging force is therefore maintained.

The action of clamping the web between each pair of pressure wheels 22 results in a radial force being applied to each pressure wheel and this radial force will vary with any variation in the thickness of the web. As described above the application of such a radial force causes the segment 69 of each pressure wheel which is in contact with the web to deform. However, since this deformation takes place only radially by the action of the portions of the annular members 66,67 in each segment, the application of this radial force does not tend to move the web laterally. Therefore the dragging force exerted by each pressure wheel pair 22 does not result in the application of any lateral force on the web which might tend to prevent correct alignment of the web under the control of the tractors 6,7.

The operations described above take place during normal forward feed of the paper web 4. In order to provide reverse feed of the web the direction of rotation of the motor 31 is reversed. During reverse feed pulley 38 drives the outer ring member 41 in the clockwise direction as viewed in FIG. 5. As described above with reference to FIG. 6, in this condition, there is a positive coupling between the outer ring member 41 and the shaft 26. The resultant positive coupling between the pulley 38 and the shaft 26 will cause the pressure wheel pairs 22 to rotate and to feed the lower portion of the web in the reverse direction (downwardly as viewed in FIG. 1). The tractors 6,7 will rotate in the reverse direction in accordance with rotation of the shaft 21 by the motor 31 and will drive the upper part of the web positively also in the reverse direction. In order to ensure that tension is maintained in the web so that printing can take place during reverse feed of the web and also to ensure that the one way clutch 39 does not become engaged during forward feed as described above, the relative sizes of the diameters of the pulleys 37, 38 and of the diameters of the tractor wheels 16 and the pressure wheels 23,24 are selected so that the speed of feed provided by the pressure wheels 23,24 is slightly greater than the speed of feed provided by the tractor wheels 16. Each of the segments 69 of the pressure wheels can move slightly in a circumferential direction relative to the adjacent segments.

Each pressure wheel tries to feed the portion of the web with which it is in contact at the faster first speed. This is opposed by the tractor wheels 16 trying to feed the web at the slower second speed. The segment of the pressure wheel which is in contact with the web deflects circumferentially and, in doing so, exerts a forward force on the web. This forward force is exerted until the pressure wheel rotates far enough so that the segment is no longer in contact with the web. At this instant the forward force is interrupted and the web is fed solely by the tractor wheels 16. The pressure wheel continues to rotate and eventually contact with the web is made by the next segment and the process is repeated. As a result the web is fed at the speed of feed provided by the tractor wheels 16 and a forward force is exerted on the web by the pressure wheels trying to feed the web at the higher speed. This forward force creates a tension in the web without any damage being done to the web.

During reverse feed the web can move laterally because each segment 69 of the pressure wheels 22, 23 can move axially as described above for forward feed. Therefore during reverse feed the alignment of the web is under the control of the tractors 6, 7.

The reverse feed operation operation described also provides for the paper web to be returned to the normal printing position after part of the web has been torn off along a set of perforations extending across the width of the web as indicated at 59 in FIG. 8. If printing has taken place on a portion of the web and it is required to tear off this printed portion, the web will need to be fed in the forward direction until the next set of perforations after the printed portion appear outside the printer, well beyond the tractors 6,7. The printed portion can then be torn off without disengaging the feed provided by the tractors. After the tearing off operation has been completed the paper web can be fed in the reverse direction until the leading edge of the paper web is located just beyond the tractors. Normal forward feeding and printing operations can then be resumed.

The pressure wheels 23,24 are carefully designed to provide the following characteristics:

a. Under the application of small radial forces the wheels deform radially a small amount in order to provide sufficient traction between the pressure wheels 23, 24 and the web 4 for feeding the web in the reverse direction.

b. Under the application of radial forces to the rim 63 the segments 69 deflect only in the radial direction.

c. Each pressure wheel exhibits sufficient stiffness in the circumferential direction to eliminate "wind up" during reverse feed and to reduce the complexity of the algorithm used to control the reverse feeding operation.

d. The area of contact between the rim 63 of each pressure wheel and the web 4 is sufficiently large to ensure that the feeding force is distributed to the web 4 evenly during the reverse feed operation and also that there is no marking of the top surface of the web or the surfaces of multiple part forms which abut against layers of carbon paper.

e. The segments 69 will deflect axially in order to allow the web 4 to move laterally so that alignment is under the control of the tractors 6, 7 during both forward and reverse feed operations.

In a practical embodiment of the invention each of the pressure wheels 23,24 was constructed from Santoprene thermoplastic rubber Grade 203-40 or 103-40 and was formed with eight equally spaced radial slots 65 defining eight segments 69 and had the following approximate dimensions referring to FIG. 10:

Outer diameter=37.5 millimeters
Diameter of hub 61=12 millimeters
Axial length of hub 61=10 millimeters
Width of each slot 65=0.25 millimeters
Thickness a=2.0 millimeters
Length b=1.0 millimeters
Length c=2.5 millimeters
Length d=6.5 millimeters
Angle X=41°
Angle Y=71°

During the operation of loading the web 4 into the printer it will be necessary for the Operator to feed the leading edge of the web between the pressure wheel pairs 22, up through the print region 5 and onto the tractors 6,7. Since the alignment of the web relative to the print mechanism 3 will be controlled by the tractors 6,7 it will only be necessary for the Operator to ensure that the web is correctly loaded onto the pins 16 of the tractor wheels. The lateral position of the web in the region of the pressure wheel pairs 22 during the loading operation is not important because the lateral position of the web will automatically be corrected as soon as forward feed starts under the control of the tractors 6,7. The correct tension will also be inserted in the web as soon as forward feed starts.

While the invention has been described with reference to a printer it will be appreciated that it can be applied to other apparatus for performing operations on a web, for example apparatus for punching holes in a web or apparatus for detecting marks on a web in which it is necessary for the web to move accurately relative to the operating mechanism.

What we claim is:

1. A printer comprising:

(a) a frame;

(b) a print mechanism for performing printing operations on a print medium;

(c) means for mounting said print mechanism on said frame; and (d) print medium feeding mechanism adapted to be bidirectionally driven for bidirectionally feeding said print medium past said print mechanism so that printing operations can be performed on said print medium by said print mechanism, said print medium feeding mechanism comprising (1) alignment and forward feed apparatus engaging said print medium for positioning said print medium at a predetermined lateral location with respect to said print mechanism when said print medium is fed in either the forward or reverse direction, and for feeding said print medium in a forward direction past said print mechaism, (2) means for mounting alignment and forward feed apparatus on said frame downstream of said print mechanism relative to the direction of forward feed of said print medium, (3) reverse feeding apparatus engaging said print medium for feeding said print medium in a reverse direction past said print mechanism, and for tensioning said print medium when said print medium is driven in a forward direction, said reverse feed apparatus comprising (i) at least one pair of pressure wheels in nipping engagement, each of said pressure wheels being flexible in the axial direction so as to permit uninhibited lateral movement in the axial direction relative to said pressure wheels such that no lateral alignement forces are exerted on said print medium by said pressure wheels, and so that alignment relative to said print mechanism is controlled wholly by said alignment and forward feed apparatus, (ii) means for rotatably mounting said pair of pressure wheels on said frame upstream of said print mechanism relative to the direction of forward feed of said print medium and so that said pressure wheels abut against opposite surfaces of said print medium being fed by said alignment and forward feed apparatus whereby forward movement of said print medium causes forward rotation of said pressure wheels, (iii) brake means for restricting the rotation of at least one of said pressure wheels only in a forward direction to exert a retarding force on the print medium while being fed in a forward direction to thereby tension said print medium as it passes said print mechanism, and (iv) one way coupling means adapted to be coupled to a drive means to drive at least one of said pressure rolls in a reverse direction only to feed said print medium in a reverse direction; and (4) bidirectional drive means for intercoupling and driving said alignment and forward feed apparatus and said pressure rolls, rotation of said bidirectional drive means in a forward direction driving said alignment and forward feed apparatus to align and feed said print medium in a forward direction as said brake means exerts a retarding force on said print medium via said pressure wheels to tension said print medium, and rotation of said bidirectional drive means in a reverse direction engaging said one way coupling means and driving at least one of said coupled pressure rolls to feed said print medium in a reverse direction without exerting any lateral alignment forces thereon, said alignment and forward feed apparatus providing the only lateral alignment forces on said print medium and exerting a retarding force on said print medium to tension said print medium.

2. A printer as claimed in claim 1 wherein each of said pressure wheels comprises a disc of flexible material, a hub at the center of said disc and adapted to be mounted on a shaft for rotation of said disc, surfaces defining a rim to said disc, and surfaces defining a plurality of radial slots formed in said disc extending from said rim to said hub and defining a plurality of segments each of which can move axially relative to the adjacent segments and thereby allow for movement in the axial direction relative to said pressure wheel of a print medium in contact with said rim.

3. A printer as claimed in claim 1 wherein said means for rotatably mounting said pair of pressure wheels on said frame includes reverse feeding apparatus comprising a shaft, means for mounting one of said pressure wheels on said shaft, drive means for driving said shaft, one way coupling means for connecting said drive means to said shaft and for causing rotation of said shaft in a reverse direction so as to cause reverse rotation of said pressure wheel and reverse feed of a print medium located between said pair of pressure wheels and for permitting free rotation of said shaft in the forward direction independently of said drive means to allow forward feed of said web.

4. A printer as claimed in claim 3 in which said reverse feed apparatus comprises first means for coupling said drive means to said shaft so as to feed a print medium passing between said pressure wheels at a first speed in the reverse direction, and second means for coupling said drive means to said forward feed apparatus for operation of said forward feed apparatus in the reverse direction so as to feed a print medium engaged with said forward feed apparatus at a second speed in the reverse direction which is slower than said first speed, characterized by the improvement that each of said pressure wheels comprises a disc of flexible material, a hub at the center of said disc and adapted to be mounted on a shaft for rotation of said disc, surfaces defining a rim to said disc, and surfaces defining a plurality of radial slots in said disc extending from said rim to said hub and defining a plurality of segments each of which can move circumferentially relative to the adjacent segments, whereby slippage occurs between each pressure wheel and said print medium and said forward feed apparatus feeds said print medium in the reverse direction at said second speed and each pressure wheel exerts a force on said print medium tending to move said print medium at said first speed so that said print medium is tensioned.

5. A printer as in claim 1 wherein said print medium comprises a web having uniformly spaced perforations along the edges thereof and said alignment and forward feed apparatus comprises rotatable means having pins protruding therefrom for engaging the corresponding edge perforations in the print medium.

* * * * *

UNITED STATES PATENT AND TRADEMARK OFFICE

CERTIFICATE OF CORRECTION

PATENT NO. : 4,621,756

DATED : Nov. 11, 1986

INVENTOR(S) : Bullock et al.

It is certified that error appears in the above-identified patent and that said Letters Patent is hereby corrected as shown below:

Claim 1, Column 10, line 17, "mechaism" should be
-- mechanism --

Claim 1, Column 10, line 33, "alignement" should be
-- alignment --

Signed and Sealed this

Third Day of February, 1987

*Attest:*

DONALD J. QUIGG

*Attesting Officer*

*Commissioner of Patents and Trademarks*